United States Patent [19]

Pichowicz

[11] 3,930,702

[45] Jan. 6, 1976

[54] HANG-IT-ALL JEWELRY CABINET

[76] Inventor: John R. Pichowicz, P.O. Box 51, Westville Road, Plaistow, N.H. 03865

[22] Filed: Aug. 8, 1974

[21] Appl. No.: 495,449

[52] U.S. Cl. ..... 312/245
[51] Int. Cl.[2] ..... A47B 67/02
[58] Field of Search ..... 312/245, 204, 326, 328

[56] References Cited

UNITED STATES PATENTS

| | | | |
|---|---|---|---|
| 858,831 | 7/1907 | Sherman, Jr. | 312/326 |
| 1,245,582 | 11/1917 | Gray | 312/245 X |
| 3,639,022 | 2/1972 | Elmo | 312/245 |
| 3,697,363 | 10/1972 | Martinez | 312/204 |

*Primary Examiner*—Paul R. Gilliam
*Assistant Examiner*—Doris L. Troutman
*Attorney, Agent, or Firm*—John C. MacNab

[57] ABSTRACT

A decorative wall cabinet for retaining an assembly of necklaces with or without medallions thereon, chains, both long and short, chains of beads, bracelets, rings and ornamental pins all in visible, convenient arrangement for selection by the wearer. The cabinet has a hinged door with a picture or other decoration on its outer surface and a mirror on its inner surface. A bar is fixed below the mirror having outwardly extending pegs or pins to hang the shorter chains or rings thereon. Inside the cabinet is a row of compartments at the top for bracelets and such jewelry, a bar having pins extending outwardly from the bar to hang long chains or necklaces thereon in spaced individual relationship. At the bottom end are two pivoted drawers having chambers therein to receive smaller items of jewelry such as pins, bars, etc.

1 Claim, 7 Drawing Figures

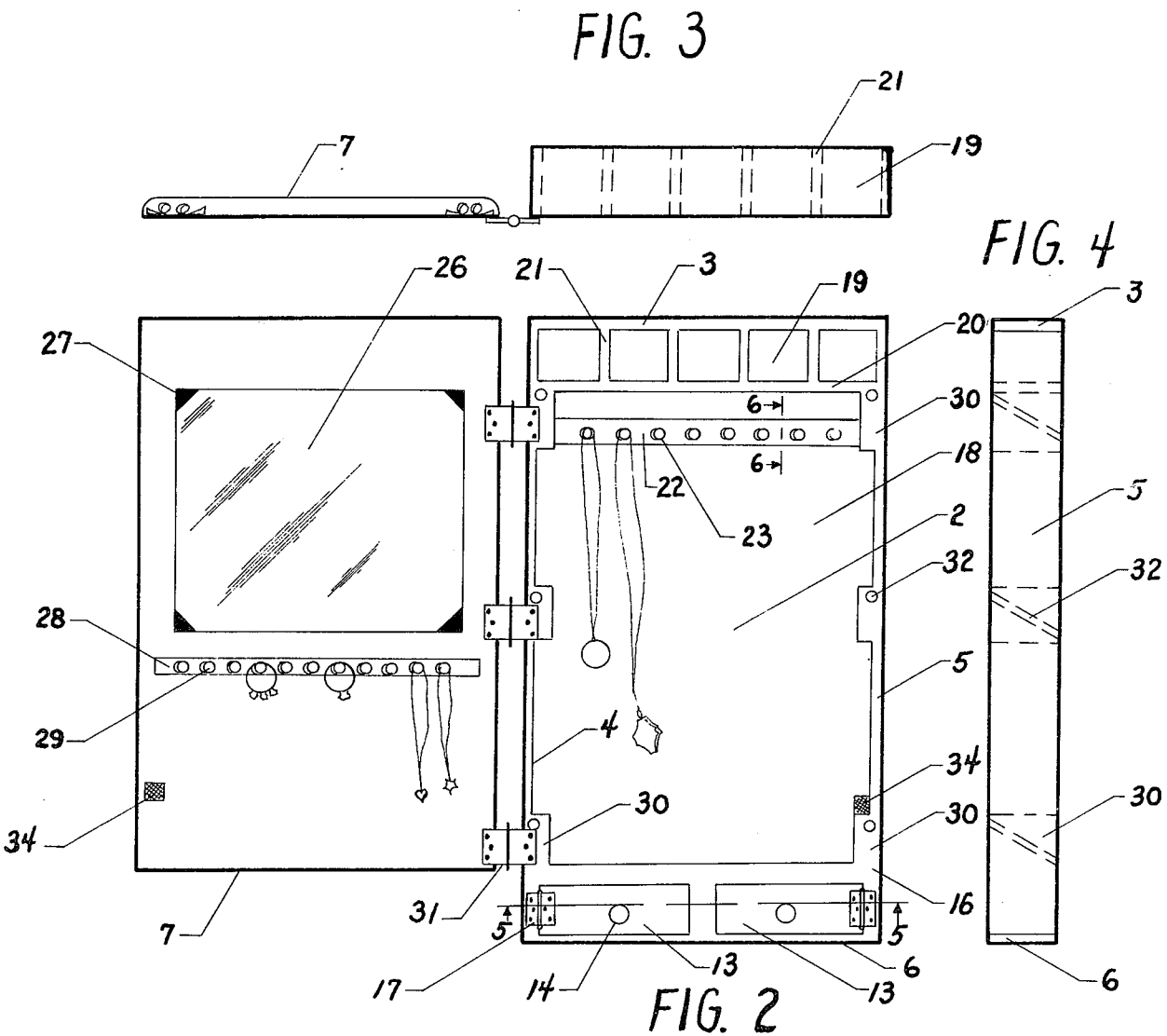
FIG. 4
FIG. 3
FIG. 2
3
5
32
30
6
19
21
20
18
2
34
16
13
14
17
23
22
4
26
7
27
28
29
31
6
5
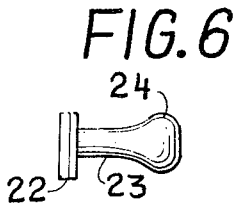
FIG. 6
24
23
22
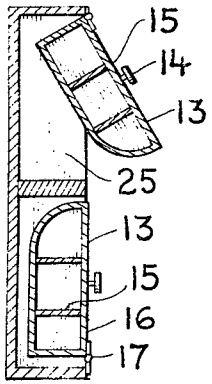
FIG. 5
15
14
13
25
13
15
16
17
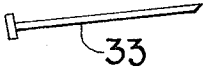
FIG. 7
33

HANG-IT-ALL JEWELRY CABINET

This invention relates to a useful, and decorative jewelry cabinet that can be easily attached to a wall or set upon a dresser or table in upright position.

It is a universal problem that when necklaces, chains and other beaded necklaces with or without pendants or charms are put in a box or drawer-type jewelry cabinet that they become terribly mixed up and tangled. Especially the very fine chains, if they become knotted, are very difficult to be untied and straightened out without damaging the expensive chain. It is noted that the necklace is about the last item to be put on when a person is getting dressed and when one is late to get to an appointment a person is generally frustrated and does not have time to untangle or unknot a necklace without damaging it.

The principal object of this invention is the provision of a cabinet to be fixedly mounted on a wall and to be used by a person to temporarily store long pendant chain necklaces, bead necklaces, very fine chain necklaces and other items of jewelry. The necklaces are hung individually on specially designed dowel type pins properly spaced to enable such necklaces to hang in spaced orderly relation so that any one may be easily, quickly and individually selected by a person desiring to use the same without interference with any other necklace and without damage to the chain selected.

Another object of this invention is to provide storage space on the inside of the cabinet door in the form of a row of pins to retain finger rings. Also there is further provided swing out type drawers to receive other jewelry items such as ornamental pins, etc.

Still further objects of the present invention are as follows:

The provision of compartments in the upper portion of the cabinet for bracelets.

A mirror is provided on the inside upper portion of the door of the cabinet so that when a necklace is tried on it may be observed by a person to match their wearing apparel thus eliminating the problem of opening and closing the cabinet door if the mirror were located on the outside surface of the door.

The exterior face of the cabinet door is provided with a slight inset panel for accomodation of a picture, a floral panel or any decorative design to match the decor of the room where the cabinet is installed.

In summary the object of this invention is to provide a cabinet that is very decorative in construction and design, rugged yet inexpensive to manufacture. The cabinet is shallow in depth to give a picture frame effect.

The cabinet is very simple to attach to the wall and automatically tightens to the wall. This cabinet provides one container for all types of jewelry objects at one convenient place hence the name - HANG-IT-ALL JEWELRY CABINET.

Other objects and advantages of this invention will become apparent from the following description taken in connection with the accompanying drawings wherein are set forth by way of illustration and example certain embodiments of this invention.

FIG. 2 is a front view of the cabinet showing the door in open position.

FIG. 3 is a top view of the opened cabinet of FIG. 2.

FIG. 4 shows the right side view of the cabinet case and illustrates by dashed lines the angular predrilled holes for attaching the cabinet to a wall, not shown.

FIG. 5 shows a sectional view of the lower end of the cabinet taken on line 5 — 5 fo FIG. 2.

FIG. 6 shows an enlarged view of one of the pins used to hang a necklace over and taken on line 6 — 6 of FIG. 2.

FIG. 7 shows a side view of one of the long slender nails to attach the cabinet to a wall.

Figure 1:
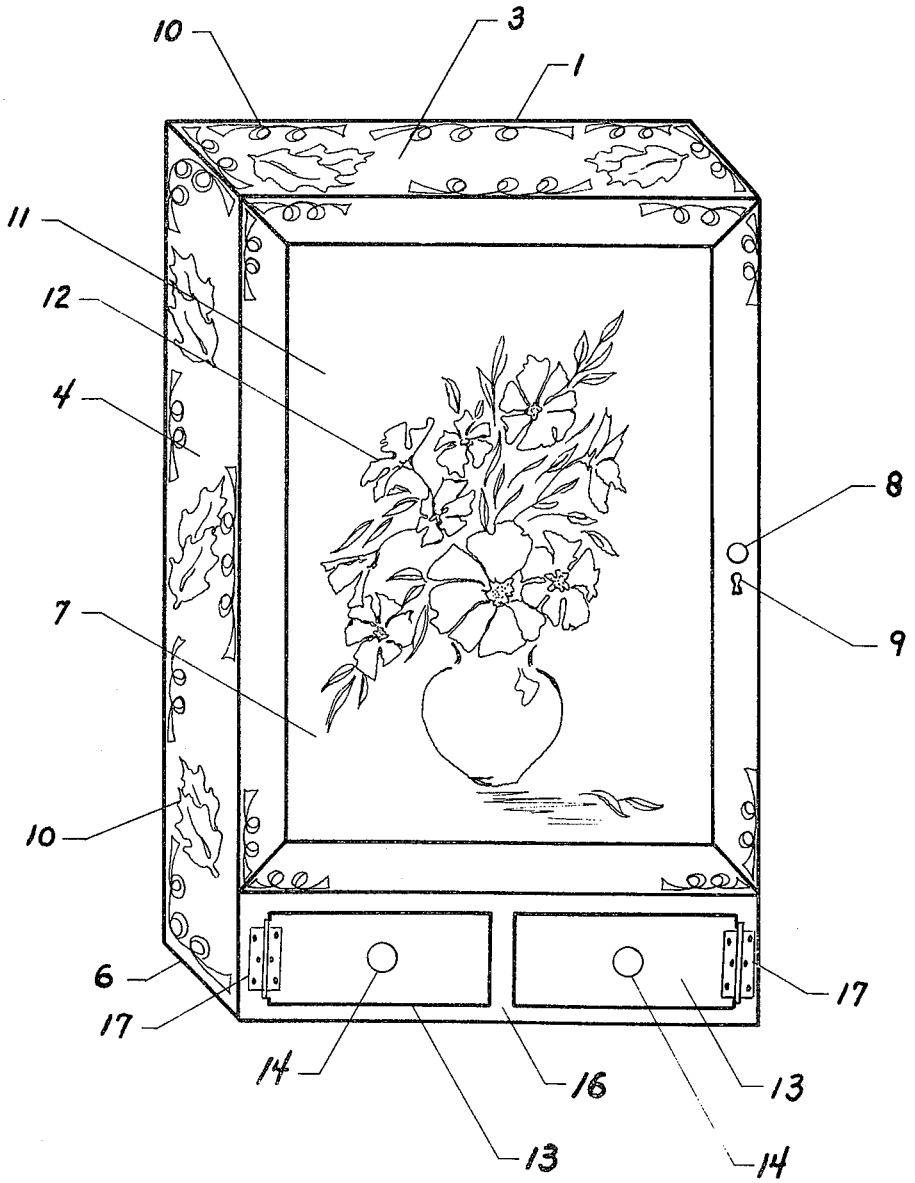
FIG. 1 is a front perspective view of the jewelry cabinet.

Reference is now made in detail to the various figures of drawings showing applicants' invention, which relates to jewelry cabinets. Applicants' cabinet is adapted to be fixedly attached to a wall or other vertical surface or to stand with its bottom on a table, dresser or other surface not shown. The cabinet 1, FIG. 1 is in the form of a vertical box of a thickness of slightly more than three inches in thickness, approximately eighteen inches in width and of an overall length of about thirtysix inches. In effect when attached to a wall, the cabinet has appearance of a picture hanging on the wall. Numeral 2, FIG. 2, indicates the back wall of the cabinet 1, while 3 indicates the top wall and 4 and 5 the side walls. The bottom wall is shown as 6 in FIGS. 1 and 2. A door 7 is hinged to an edge of the side wall 4 and forms a closure for the front of the cabinet.

The jewelry cabinet 1 is shown in perspective in FIG. 1 wherein numeral 7 constitutes the hinged door having a knob 8 or other type of handle to be grasped by a hand to conveniently open the door. Below the knob or handle 8 is a key operated lock 9 for locking the cabinet 1 for privacy and protection. The outer surface of the top wall 3 of the cabinet 1 and the surface of side walls 4 and 5 thereof may have embossed decorative design 10 thereon. It is further noted that the front panel 11 of the door is recessed slightly to receive one of a selection of floral pictures 12 or other decorative picture or design which may be glued to the panel 11 as desired by the owner of the cabinet.

As can be seen in FIGS. 1, 2, and 5 there are two swing out drawers 13 located in the lower part of the cabinet 1 having knobs 14 to open and close the same. The drawers may be lined with soft material or fabric and have partitions 15 therein, FIG. 5 forming compartments for jewelry pins or other miscellaneous small jewelry articles. Drawers 13 are hinged to the lower front wall 16 of the cabinet 1 by hinges 17 which support and guide the drawers 13.

FIG. 2 shows a front view of the jewelry cabinet 1 showing the door 7 in open position and the interior chamber or box 18 in detail. Adjacent the top wall 3 of the chamber 18 are several compartments 19 defined by top wall 3, a bottom wall 20 and several verticle partitions 21. These compartments 19 are each lined with soft material such as velvet or felt and are used to receive bracelets or like jewelry items. Just below these compartments 19 a horizontal bar 22 extends between the side walls 4 and 5 and back wall 2 of the chamber 18. The ends of bar 22 are fixedly attached to the side walls 4 and 5. Attached to and extending from the bar 22 are a number of spaced pins 23 as shown in FIGS. 2 and 6. Each pin 23 has a small head 24, FIG. 6, on its outer end. These pins 23 serve as supports for hanging a number of long chain necklaces or long strings of beads in vertically spaced positions each separate from each other. The chains may have medallions or other ornaments thereon. In the lower end of the cabinet 1 is a second chamber 25 having the front wall 16 of the cabinet, side walls 4 and 5 and the back wall 2 of the cabinet defining said chamber 25. This second chamber 25 FIG. 5 contains the two swing out drawers 13 described above.

The interior surface of the hinged door 7, FIG. 2 has a relatively large mirror 26 fixedly attached thereto by fastenings 27. The mirror 26 makes it convenient for a person selecting a necklace or string of beads to see if it matches her costume. Having the mirror 26 located on the inside surface of the door it is not necessary to close it to view the selected necklace on the person. This leaves the exterior of the door for decorative purposes as mentioned above. Below the mirror 26, a second bar 28 is fixedly secured to the interior surface of the door 7. This bar 28 carries a second series of pins 29 similar to the pins 23 on the bar 22. These pins 29 are for temporary storage of finger rings, short necklaces and other items of jewelry.

The cabinet 1 is constructed of wood, pressed wood, pressed organic composition, plastic or metal or other available material to help keep the manufacturing costs down and yet make an attractive durable cabinet. The side walls 4 and 5, FIG. 2 are rather thin to reduce the weight of the cabinet. To each side wall there are reinforcing blocks 30 fixedly attached as shown in FIG. 2. On one side 4 of the cabinet, hinges 31 are screwed or otherwise attached to said blocks 30 and the door 7 to support the door. These blocks 30 also have drilled openings 32 therethrough as best seen in FIGS. 2 and 4. As seen in FIG. 4 these openings extend at an angle downwardly from the front to the rear of the cabinet to receive nails 33 of the type shown in FIG. 7. These nails are provided to attach the cabinet to a wall or other verticle surface. To mount the cabinet on the wall, the cabinet is held flat against said wall with the cabinet door open, the nails are inserted in the drilled openings 32 and hammered home. The slanting angle of the nails in the wall make a very solid connection of the cabinet to the wall. The weight of the cabinet and its normal use tends to improve the stability of this connection of the cabinet to the wall. A portion of a magnetic catch 34 is attached to the door FIG. 2 and a second portion of said catch 34 is attached to one of the blocks 30 on the side wall 5 of the cabinet as seen in FIG. 2. This magnetic catch serves to retain the door 7 in closed position on the cabinet when the cabinet is not in use.

I claim:

1. A decorative wall cabinet for receiving and storing ladies jewelry; comprising, a thin box like chamber having a back wall, a top wall, side walls, a bottom wall and a lower short front wall, a door covering the front of said chamber except for the short front wall thereof;

concealed hinges pivotally connecting the door to one of the side walls of the box;

said door having a front surface and a back surface;

a slightly recessed panel on the front outer surface of the door;

a decorative member mounted in said panel giving the visual effect to the wall cabinet of a picture hanging on the wall;

a large mirror;

means fixedly mounting said mirror on the back surface of said door;

a bar;

means mounting said bar on the back surface of the door below the mirror;

pins having slightly rounded heads fixed to and extending outwardly from said bar to receive short necklaces or chains in hanging position;

means forming a row of compartments adjacent the top box like chamber to receive small articles of jewelry;

a second bar;

means fixedly mounting said second bar to the sides and back walls of said box like chamber below the row of compartments;

a second row of headed pins mounted in and projecting from said second bar to receive long chains or necklaces in spaced hanging position;

a compartment bounded by the short front wall, the side walls, the back wall and the bottom wall of the box like chamber;

two drawers in said compartment;

hinge means attached to the short front wall of the chamber attaching the drawers to the chamber to allow the drawers to swing into and out of said compartment;

partitions in said drawers forming pockets to receive small articles of jewelry means including nails for fixedly attaching said cabinet to a vertical surface such as a wall whereby there is provided a cabinet wherein ladies jewelry may be retained in a neat orderly arrangement with the fine gold chains and strings of beads in spaced hanging relation and not in the mixed up, tangled and knotted condition experienced when storing them in a horizontal box normally used for jewelry wherein the side walls have reinforcing blocks fixedly attached to the inner surface of said walls, mounting blocks including inclined openings therethrough to receive said nails in downwardly slanting positions to cause the cabinet to be fixedly attached to a wall in increasingly tighter position.

* * * * *